United States Patent [19]

Umemoto

[11] Patent Number: 5,060,608

[45] Date of Patent: Oct. 29, 1991

[54] ENGINE CONTROL APPARATUS

[75] Inventor: Hideki Umemoto, Himeji, Japan

[73] Assignee: Mitsubishi Denki Kabushiki Kaisha, Tokyo, Japan

[21] Appl. No.: 628,914

[22] Filed: Dec. 14, 1990

[30] Foreign Application Priority Data

Jan. 12, 1990 [JP] Japan ..... 2-3374

[51] Int. Cl.[5] ..... F02B 77/00

[52] U.S. Cl. ..... 123/198 D; 123/335

[58] Field of Search ..... 123/198 D, 198 DC, 334, 123/335, 340

[56] References Cited

U.S. PATENT DOCUMENTS 3,158,143 11/1964 Heidner ..... 123/335
4,459,951 7/1984 Tobinaga et al. ..... 123/335
4,562,801 1/1986 Koike ..... 123/198 DC
4,966,115 10/1990 Ito et al. ..... 123/335

FOREIGN PATENT DOCUMENTS 300066 12/1989 Japan .

*Primary Examiner*—Noah P. Kamen
*Attorney, Agent, or Firm*—Sughrue, Mion, Zinn, Macpeak and Seas

[57] ABSTRACT

An engine control apparatus comprises a revolution speed sensor for detecting the number of revolutions of an internal combustion engine, an abnormality detecting means for detecting abnormality in the engine, and a control means for increasing or decreasing the number of misfire cylinders so that the revolution speed of the engine is brought down by a limited degree corresponding to a degree of abnormality of the engine when the abnormality is detected.

2 Claims, 3 Drawing Sheets

FIGURE 2

| | | | | | | | |
|---|---|---|---|---|---|---|---|
| TEMPERATURE | NG | NG | NG | OK | OK | OK | OK |
| OIL LEVEL | OK | NG | NG | NG | NG | OK | OK |
| BATTERY VOLTAGE | OK | OK | NG | OK | NG | NG | OK |
| REVOLUTION NUMBER | NA | NB | NC | ND | NE | NF | |
| DISPLAY OF ABNORMALITY | "a" | "b" | "c" | "d" | "e" | "f" | |

ENGINE CONTROL APPARATUS

BACKGROUND OF THE INVENTION

1. Field of the Invention

The present invention relates to an engine control apparatus for preventing an internal combustion engine such as an outboard engine, from excessive revolution.

2. Discussion of Background

In a conventional outboard engine provided with an analogue control circuit, when an abnormal state of the engine, e.g. overheating of the engine is detected, misfiring is caused at all cylinders to thereby reduce the revolution speed of the engine, and when the revolution speed becomes a predetermined value or lower, all the cylinders are again ignited. Accordingly, the conventional outboard engine has a disadvantage of a large change in the number of revolutions of the engine.

In the worst case, a ship with the outboard engine on the sea cannot sometimes return to a harbor in a case that the engine completely stops when the abnormality is detected.

Thus, in the conventional engine control apparatus, there was a disadvantage of a large change in the revolution speed since the misfiring is caused at all cylinders when the abnormality is detected.

SUMMARY OF THE INVENTION

It is an object of the present invention to provide an engine control apparatus capable of smaller changes in the number of revolution of the engine even when abnormality is detected on the engine.

The foregoing and other objects of the present invention have been attained by providing an engine control apparatus which comprises a revolution speed sensor for detecting the number of revolutions of an internal combustion engine, an abnormality detecting means for detecting abnormality in said engine, and a control means for increasing or decreasing the number of misfire cylinders so that the revolution speed of the engine is brought down by a limited degree corresponding a degree of abnormality of the engine when the abnormality is detected.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 is a diagram showing the operation of the embodiment shown in FIG. 1.

DETAILED DESCRIPTION OF THE PREFERRED EMBODIMENTS

Figure 1:
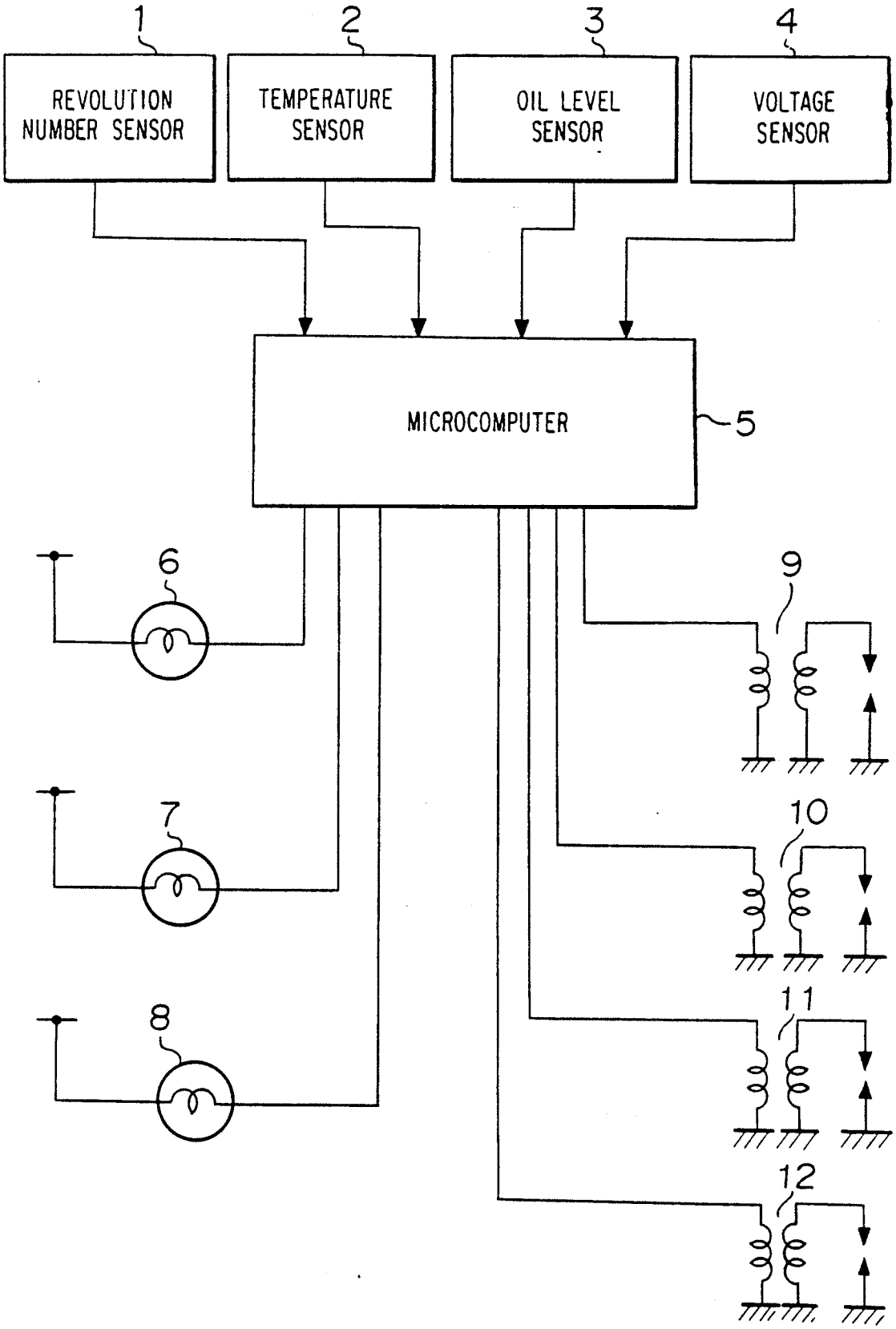
FIG. 1 is a block diagram showing an embodiment of the engine control apparatus according to the present invention.

Referring to the drawings wherein the same reference numerals designate the same or corresponding parts, and more particularly to FIG. 1, there is shown a block diagram of an embodiment of the engine control apparatus of the present invention.

In FIG. 1, the engine control apparatus of an embodiment of the present invention comprises a revolution speed sensor 1, a temperature sensor 2, an oil level sensor 3, a voltage sensor 4, a microcomputer 5 connected to the above-mentioned sensors 1–4, a temperature abnormality display device 6 which is connected to the microcomputer 5, an oil level abnormality display device 7, a voltage abnormality display device 8, a first ignition coil 9 for the first cylinder connected to the microcomputer 5, a second ignition coil 10 for the second cylinder, a third ignition coil 11 for the third cylinder, and a fourth ignition coil 12 for the fourth cylinder.

An abnormality detecting means used for the embodiment of the present invention is constituted by the temperature sensor 2, the oil level sensor 3 and the voltage sensor 4. A control means used for the embodiment of the present invention is constituted by the microcomputer 5.

Figure 3:
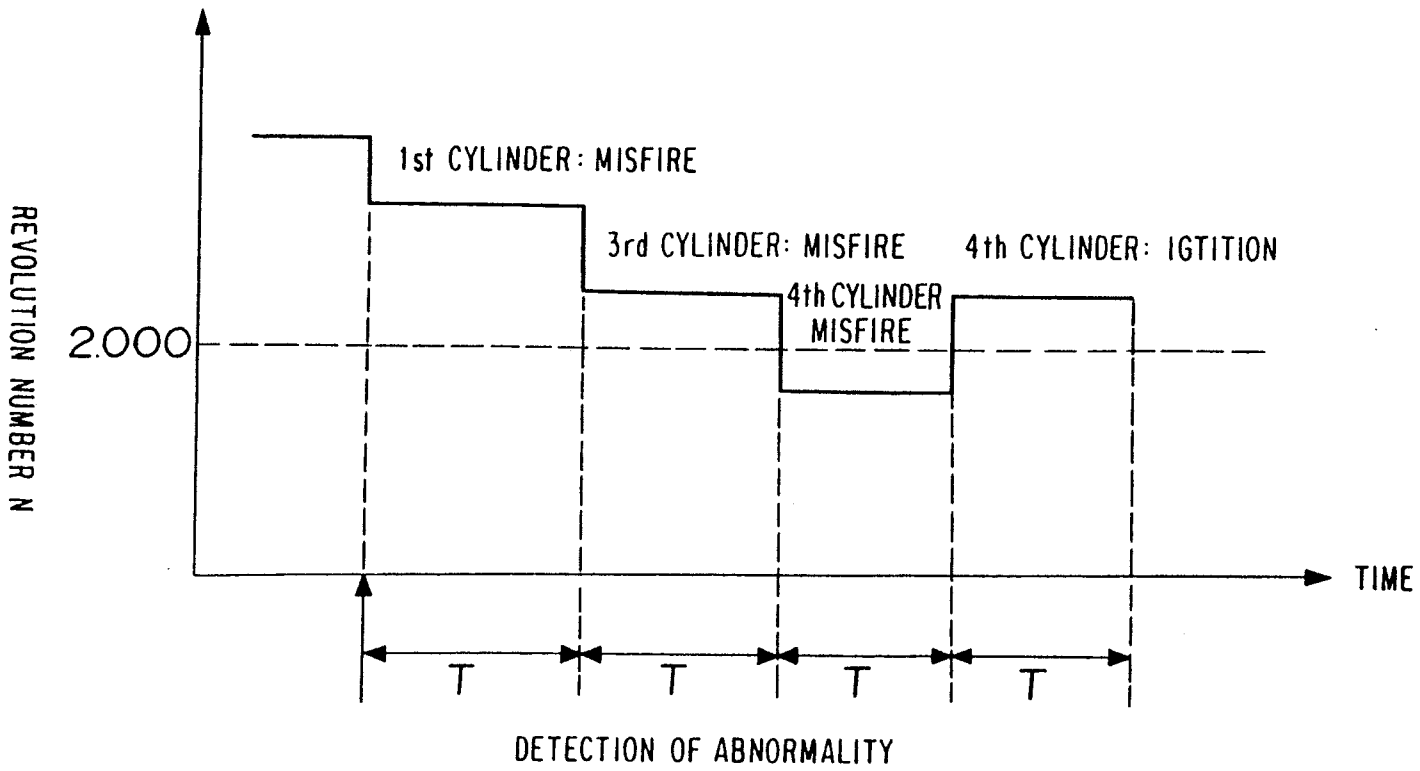
FIG. 3 is a characteristic diagram showing the relation of the number of revolution to time in the embodiment as shown in FIG. 1.

The operation of the above-mentioned embodiment will be described with reference to FIGS. 2 and 3 wherein FIG. 2 is a diagram showing the operation of the embodiment and FIG. 3 is a characteristic diagram showing the relation of the engine revolution speed N to time in the embodiment.

The revolution speed sensor 1 detects the number of revolution of the engine, the temperature sensor 2 detects the temperature of the engine, the oil level sensor 3 detects the level of engine oil and the voltage sensor 4 detects the voltage of the battery.

As shown in FIG. 2, the microcomputer 5, when the temperature sensor 2 detects a state of overheating (NG), limits the number of revolution of the engine to a predetermined value "NA". At the same time, the microcomputer operates (as shown by a letter "a") the temperature abnormality display device 6, whereby an operator knows the engine in an overheating state.

Namely, the microcomputer controls so that misfiring is caused in the cylinders in a predetermined order to thereby obtain the revolution speed "NA" while the number of revolution of the engine is monitored by the revolution speed sensor 1.

The microcomputer limits the number of revolution of the engine to a predetermined revolution value "ND" when the oil level sensor 3 detects the level of the engine oil to be a predetermined level(NG) or lower. At the same time the microcomputer 5 operates (as indicated by a letter "d") the oil level abnormality display device 7, whereby the operator knows a shortage of the engine oil. Namely, the microcomputer 5 operates so that misfiring is caused in the cylinders in a predetermined order to thereby obtain the revolution speed "ND" while the number of revolution of the engine is monitored by the revolution speed sensor 1.

The limitation of the revolution speed of the engine depending on various conditions is shown in FIG. 2.

FIG. 3 shows an example that the number of revolution N is limited to 2,000 rpm. In the example as shown in FIG. 3, the misfiring is caused in the cylinders in the order of 1st cylinder →3rd cylinder →4th cylinder at constant time intervals from the time point at which an abnormal state of the engine is detected. The order of the cylinders in which misfiring is caused is determined in consideration of the engine rotation balance.

In the above-mentioned embodiment of the present invention, the number of revolution of the engine is previously determined depending on various conditions of abnormality which may occur in the engine, and misfiring and ignition are caused in the cylinders in a predetermined order at a constant time intervals T so that a limited number of revolution of the engine is obtainable by the control of the microcomputer 5. Accordingly a change of the revolution speed of the engine can be small, and accordingly, comfortable driving can be provided.

In the engine control apparatus of the present invention, the engine is not stopped even when the abnormality of the engine is detected. Accordingly, a ship with an outboard engine in which the engine control apparatus of the present invention is installed can return to a harbor even when the abnormality occurs on the sea.

Description has been made as to the four cylinder engine. However, the same effect can be obtained by another multi-cylinder engine provided with the engine control apparatus of the present invention.

In the above-mentioned embodiment, the revolution speed of the engine is determined on the basis of the abnormality in the temperature of the engine, the oil level and the battery voltage. However, the same effect can be attained by determining the revolution speed on the basis of other conditions.

Although the number of the cylinders misfired and ignited is increased or decreased at constant time intervals T, the same effect can be expected by controlling the cylinders misfired and ignited in a random order at irregular time intervals.

The engine control apparatus of the present invention is applicable to other internal combustion engine than the outboard engine.

Thus, in accordance with the present invention, a change of the number of revolution of the internal engine can be reduced.

Obviously, numerous modifications and variations of the present invention are possible in light of the above teachings. It is therefore to be understood that within the scope of the appended claims, the invention may be practiced otherwise than as specifically described herein.

What is claimed is:

1. An engine control apparatus which comprises:

a revolution speed sensor for detecting the number of revolutions of an internal combustion engine;

an abnormality detecting means for detecting abnormality in said engine, and a control means for or increasing the number of misfire cylinders so that the revolution speed of the engine is brought down by a limited degree corresponding to a degree of abnormality of the engine when the abnormality is detected.

2. The engine control apparatus according to claim 1, wherein said abnormality detecting means comprises a temperature sensor for detecting the temperature of the engine, an oil level sensor for the engine, and a voltage sensor for detecting the voltage of the battery.

* * * * *